US006062915A

United States Patent [19]

Costello et al.

[11] Patent Number: 6,062,915

[45] Date of Patent: May 16, 2000

[54] NONDEFORMING ELECTRODE CONNECTOR

[75] Inventors: Michael Costello, Salt Lake City; Ralph Koschinsky, Midvale, both of Utah

[73] Assignee: Iomed, Inc., Salt Lake City, Utah

[21] Appl. No.: 09/244,734

[22] Filed: Feb. 5, 1999

[51] Int. Cl.[7] ..... H01R 4/48

[52] U.S. Cl. ..... 439/729; 439/909

[58] Field of Search ..... 439/729, 759, 439/822, 909, 910

[56] References Cited

U.S. PATENT DOCUMENTS

| | | | |
|---|---|---|---|
| 3,031,642 | 4/1962 | Gartner, Jr. | 439/822 |
| 3,606,881 | 9/1971 | Woodson . | |
| 3,842,394 | 10/1974 | Bolduc | 439/909 |
| 4,061,408 | 12/1977 | Bast et al. | 439/729 |
| 4,072,388 | 2/1978 | Dunn . | |
| 4,550,961 | 11/1985 | Aicher et al. | 439/909 |
| 4,555,155 | 11/1985 | Drake . | |
| 4,702,256 | 10/1987 | Robinson et al. . | |
| 4,797,125 | 1/1989 | Malana | 439/729 |
| 4,911,657 | 3/1990 | Berlin | 439/729 |
| 5,407,368 | 4/1995 | Strand et al. | 439/729 |
| 5,498,235 | 3/1996 | Flower | 439/909 |

*Primary Examiner*—Lincoln Donovan
*Assistant Examiner*—Hae Moon Hyeon
*Attorney, Agent, or Firm*—Factor & Partners

[57] ABSTRACT

An electrode connector for securely holding a thin flexible electrode. The electrode connector includes a bottom jaw member and an upper jaw member that are selectively movable between an open position and a closed position. The upper jaw member and the bottom jaw member are biased into a closed position. The electrode connector includes an electrical contact assembly configured to provide electrical contact with the flexible electrode. The electrical contact assembly comprises a contact platform and a contact pin attached thereto. The contact platform is configured to form an electrical contact with the contact area of the flexible electrode. The contact pin is sized and configured to be at least partially disposed in the aperture formed in the flexible electrode such that upon the upperjaw member and the lower jaw member moving to the closed position electrical contact is formed and maintained with the contact area of the flexible electrode without permanently deforming the contact area thereof. The electrical contact assembly further comprises a recess formed opposite the contact pin that is sized and configured to receive both the contact pin disposed in the aperture of the flexible electrode and a portion of the contact area of the flexible electrode. The contact assembly is configured such that disposing the contact pin in the aperture in the flexible electrode provides a visual indicator to medical personnel that the contact assembly and the flexible electrode are correctly aligned so as to form an electrical contact. A visual access opening is in communication with the recess to enhance the ability of the medical personnel to determine that the contact pin is disposed in the aperture of the flexible electrode. In addition, disposing the contact pin in the aperture in the flexible electrode positively locks the connector to the flexible electrode and prevents accidental disengagement.

32 Claims, 4 Drawing Sheets

NONDEFORMING ELECTRODE CONNECTOR

BACKGROUND OF THE INVENTION

1. The Field of the Invention

The present invention relates to an electrode connector. More particularly, this invention relates to an electrode connector that securely engages a flexible electrode without permanently deforming the flexible electrode.

2. The Relevant Technology

Electrodes and electrode connectors are commonly used in the medical industry to monitor the physiological functioning of the human body that results in certain electrical phenomenons. The electric signals are typically monitored, for example, by electrocardiographic instrumentation. In most cases, the electrocardiographic instrumentation includes a lead cable, an electrode connector, and an electrode. The lead cable is connected to the instruments, and the electrode is attached to the skin of the patient. Connectors are used to connect the lead cable and the electrode. The electrode is often attached to the skin of the patient by various methods including tape or a suction cup used in combination with an electrically conductive gel or cream when it is attached to the electrode connector.

There are many different designs of electrode connectors that are currently available. The electrode connector must be able to securely fasten the electrode connector to an electrode. One reason it is important that the connector be securely attached to the electrode is to avoid shocking the patient or separating from the electrode when the patient moves. Any movement by the patient causes dislocating forces between the electrode connector and the contact portion of the flexible electrode. The electrode connector also needs to be durable so that it can be repeatedly used. It is important that the electrode connector have a relatively long life. Further, a good connection must be maintained so that the instruments can accurately read and interpret the electric signals.

There has been a recent movement in the medical field to utilize electrodes that are somewhat flexible. In fact, in some cases a portion of the flexible electrode actually acts as the contact area of the electrode. The flexible electrode is usually directly attached to the skin of the patient which in some cases may be for an extended period of time.

One type of electrode connector that is commonly used in the medical field is a variation of what is known as an electrical alligator clip. Typically, the electrical alligator clip is an industrial alligator clip with a plastic sheath that has been heat shrunk thereover to extend over the majority of the portion of the clip body. The open-jaw portion of the alligator clip closes on the contact portion of the electrode to securely hold the electrode therebetween. One variation on this type of design is that the alligator clip has a combination of side serrated teeth and opposed rows of parallel teeth for grasping the electrode. This design allows the electrode connector to grasp an exposed contact edge of the flexible electrode.

Other types of electrode connectors that are available include an electrode connector that is basically an alligator clip but holds the flexible electrode using a prong which actually stretches and deforms the contact area of the flexible electrode as the alligator clip closes. The contact of the flexible electrode is pinched between the prong and the opening in the jaw of the alligator clip itself. As the jaws of the alligator clip close, the prong actually stretches and permanently deforms the flexible electrode until the contact or flexible electrode is positioned in the recess or opening that receives the prong. One problem associated with a connector that permanently deforms the electrode in order to establish a strong electrical contact is that if the electrode does not consist of a material which can be stretched and/or deformed by the prong of the alligator clip, it cannot be used with this alligator clip or will not form a strong electrical contact. Further, as there is the possibility that the materials will not form a good contact with the jaws of the alligator clip itself, the connector is less effective in making a secure contact with the electrode.

In those cases that the electrode connector becomes separated from the electrode, perhaps because of movement by the patient, an electrode with a contact area that has been deformed by the prong of the electrode connector may not be able to form a good connection upon being reattached to the connector. In this case, the electrode must be removed and a new, nondeformed electrode be reattached to the patient. This is time consuming and wasteful. Further, frequent replacement of the electrode can result in irritation and even damage of the skin of the patient, particularly on those patients such as an elderly patient who may have fragile skin.

Other types of electrode connectors that are available have the drawback that it is not possible for the user of the electrode connector to know for sure that when the jaws of the connector close, the positioning of the contact area is aligned with the correct spot on the connector. An additional drawback to available electrode connectors is that there are times that because of a patient moving or for some reason such as the wires attached to the electrode connector becoming tangled with another medical instrument that the electrode connector may be accidentally disconnected from the flexible electrode.

What is needed is an electrode connector which provides a visual indication that the flexible electrode is correctly positioned relative to the electrode connector so that a good electrical connection can be formed. Further, an electrode connector is needed that cannot be accidentally disconnected from the flexible electrode. Finally, there is a need for an electrode connector which forms a good electrical connection without permanently deforming the flexible electrode.

SUMMARY AND OBJECTS OF THE INVENTION

It is an object of the present to provide an electrode connector that securely holds a flexible electrode without permanently deforming the flexible electrode.

Another object of the present invention to provide an electrode connector that is configured so that the user can visually determine that the contact area of the flexible electrode is in the correct position such that when the electrode connector is closed, a strong electrical contact will be formed.

Another object of the present invention is to provide an electrode connector that is configured to prevent accidental disengagement of the electrode connector and the flexible connector.

Yet another object of the present invention to provide an electrode connector that is configured to be positively locked to the flexible electrode.

A further object of the present invention is to provide an electrode connector that consistently and reliably provides good electrical contact upon being interconnected with a flexible electrode.

These and other objects and features of the present invention will become more fully apparent from the following description and appended claims, or may be learned by the practice of the invention as set forth hereinafter.

To achieve the foregoing objects, and in accordance with the invention as embodied and broadly described herein, an electrode connector for securely holding a thin flexible electrode that has an aperture formed therethrough and a contact area is provided. The electrode connector includes a bottom jaw member and an upper jaw member that is attached to the bottom jaw member. The upperjaw member and bottom jaw member are selectively movable between an open position and a closed position. The electrode connector includes an electrical contact assembly that is configured to provide electrical contact with the flexible electrode. The electrical contact assembly comprises a contact platform attached to one of the bottom jaw member or the upper jaw member and a contact pin attached to the contact platform. The contact platform is configured to form an electrical contact with the contact area of the flexible electrode. The contact pin is sized and configured to be at least partially disposed in the aperture formed in the flexible electrode such that upon the upperjaw member and the lower jaw member moving to closed position electrical contact is formed and maintained with the contact area of the flexible electrode without permanently deforming the contact area thereof. The contact pin extends substantially vertically away from either the bottom member or the upper member.

The electrical contact assembly further comprises a recess formed in one of the bottom jaw member or the upper jaw member opposite the contact pin. In one embodiment of the electrode connector, the recess is formed in the upper jaw member and the contact platform is attached to the bottom jaw member. The recess is sized and configured to receive both the contact pin disposed in the aperture of the flexible electrode and a portion of the contact area of the flexible electrode. Upon the upper jaw member and the bottom jaw member being in the closed position both the contact pin disposed in the aperture of the flexible electrode and a portion of the contact area of the flexible electrode are held in the recess without permanently deforming the contact area of the flexible electrode.

The contact assembly is configured such that disposing the contact pin in the aperture in the flexible electrode provides a visual indicator to medical personnel that the contact assembly and the flexible electrode are correctly aligned so as to form an electrical contact. A visual access opening is formed in either the upper jaw member or the lower jaw member opposite the contact pin and is in communication with the recess to enhance the ability of the medical personnel to determine that the contact pin is disposed in the aperture of the flexible electrode. In addition, disposing the contact pin in the aperture in the flexible electrode positively locks the connector to the flexible electrode. The upper jaw member and the bottom jaw member are biased into said closed position, thereby urging said contact pin into said recess.

BRIEF DESCRIPTION OF THE DRAWINGS

In order that the manner in which the above-recited and other advantages and objects of the invention are obtained, a more particular description of the invention briefly described above will be rendered by reference to a specific embodiment thereof which is illustrated in the appended drawings. Understanding that these drawings depict only a typical embodiment of the invention and are not therefore to be considered to be limiting of its scope, the invention will be described and explained with additional specificity and detail through the use of the accompanying drawings in which.

DETAILED DESCRIPTION OF THE PREFERRED EMBODIMENTS

The present invention relates to an electrode connector that is configured to form an electrical connection with a thin flexible electrode without permanently deforming the flexible electrode. Typically, an electrode connector is used while the flexible electrode is attached to the skin of the patient. Therefore, the electrode must be configured such that it can be securely attached to the electrode and maintain a good electrical connection even in those cases when there is movement by the patient. One reason that it is important that the electrode be able to maintain the secure attachment to the flexible electrode is to prevent any accidental disconnection should the electrode become disengaged from the connector. Further, it is important that medical personnel be able to quickly and accurately determine that the electrode and the electrode connector are correctly positioned to form a strong electrical contact.

Figure 1:
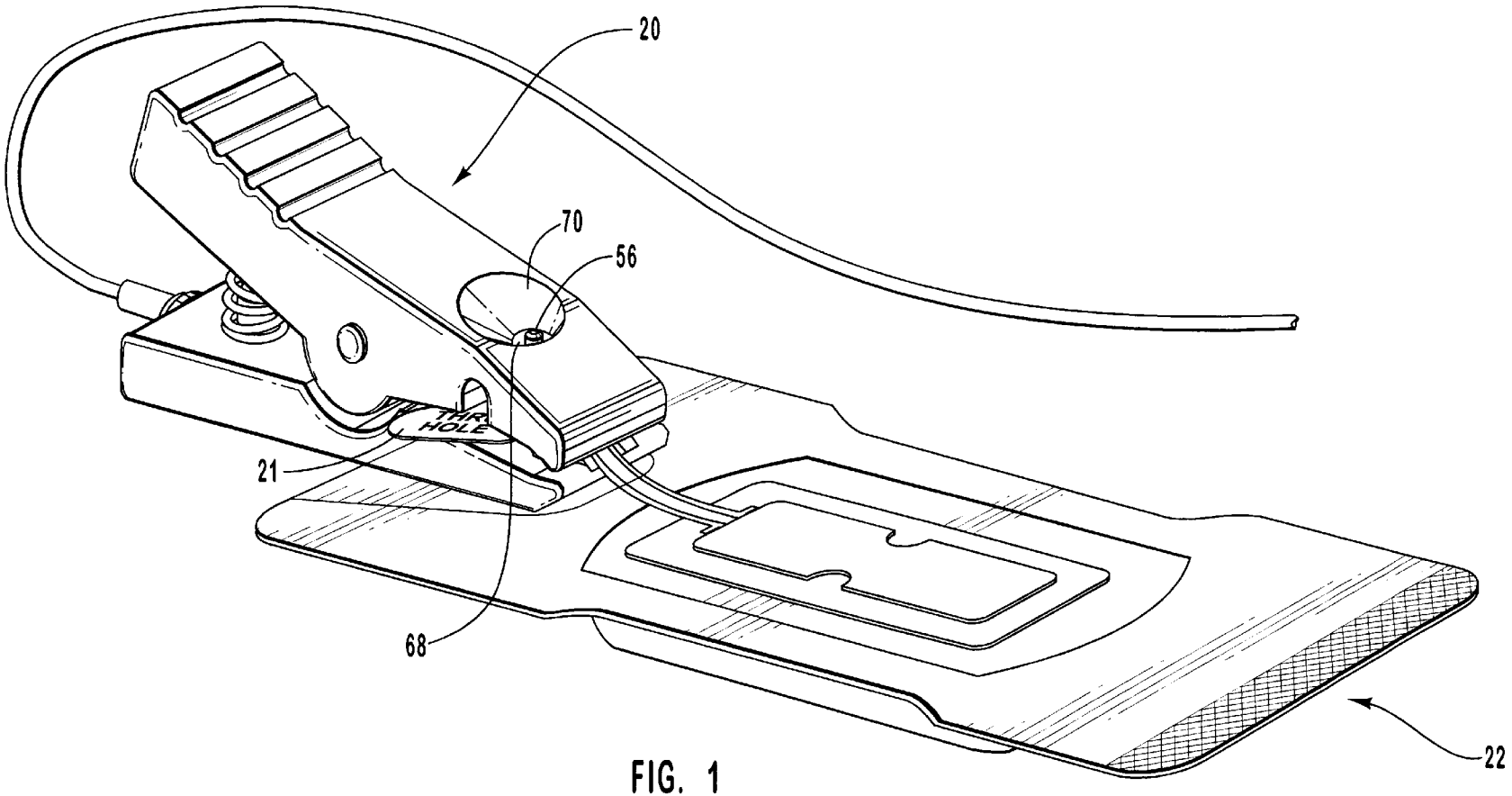
FIG. 1 is a perspective view of one embodiment of an electrode connector attached to one type of a flexible electrode.

FIG. 1 illustrates one embodiment of an electrode connector, such as connector 20, that can be attached to at least a portion of an electrode. As can be seen, one embodiment of electrode 22 is a thin, flexible electrode. Electrode connector 20 is attached to a portion of flexible electrode 22 such that an electrical contact is formed between therebetween. As depicted in FIG. 1, one embodiment of flexible electrode 22 includes a tab portion 21 which can be lifted above flexible electrode 22 and attached to electrode connector 20. Electrode connector 20 has a closed position shown in FIG. 2 and an open position as depicted by the phantom lines also in FIG. 2. In the closed position, electrode connector 20 is securely attached to flexible electrode 22 and an electrical contact is formed therebetween. When electrode connector 20 is in the open position, flexible electrode 22 can be inserted or removed from electrode connector 20.

Figure 3:
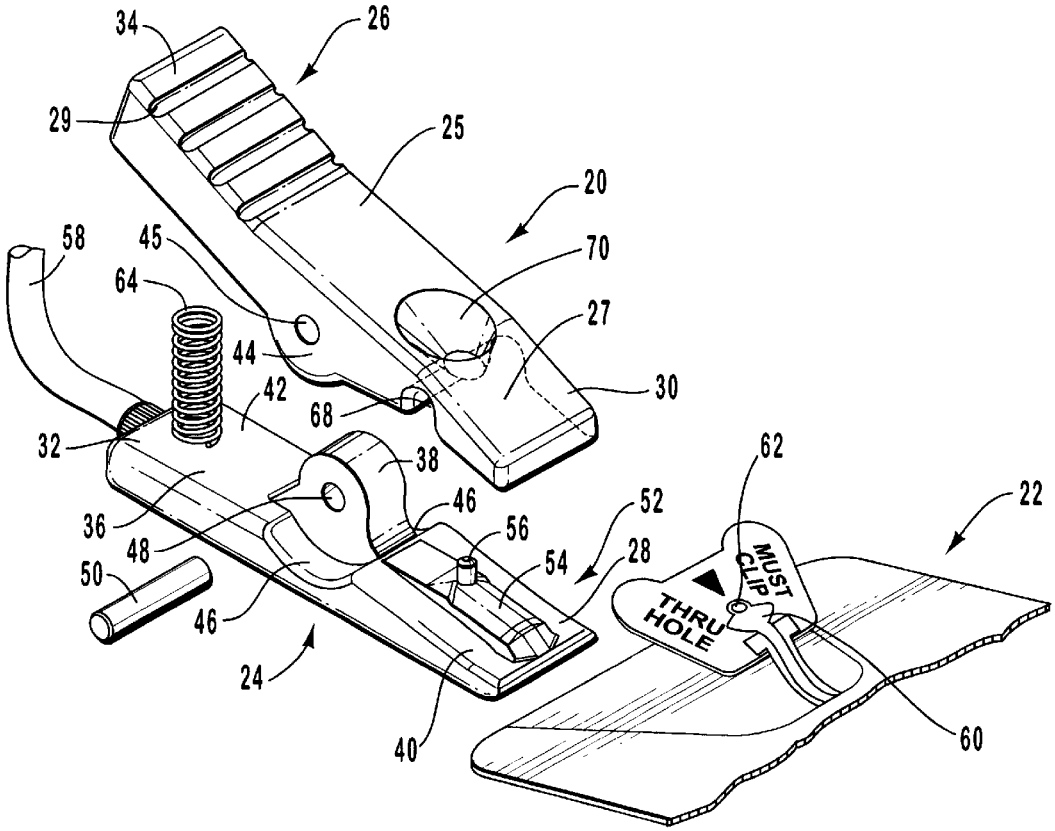
FIG. 3 is a partially exploded perspective view of the structure of FIG. 1.

As illustrated in FIG. 3, electrode connector 20 comprises a bottomjaw member 24 and an upper jaw member 26 that are sized and configured to cooperate together. Bottom jaw member 24 and upper jaw member 26 are elongated members that are substantially rectangular in shape. Bottom jaw member 24 and upper jaw member 26 have a distal end 28 and 30 and a proximal end 32 and 34, respectively. It can be appreciated by one skilled in the art that both bottom jaw member 24 and upper jaw member 26 may have various configurations other than the rectangular form illustrated and perform the function thereof. For example, distal ends 28 and 30 of bottom jaw member 24 and upper jaw member 26, respectively, could be more rounded, ovular, or semi-circular shaped. Further, the longitudinal sides of bottom jaw member 24 and upper jaw member 26 may be tapered in some fashion to assist the user in holding them or for various other reasons without affecting the function thereof.

Bottom jaw member 24 includes a body portion 36, an attaching piece 38, and a gripping portion 40. In one embodiment illustrated in FIG. 3, body portion 36 forms proximal end 32 of bottom jaw member 24 and has a substantially rectangular cross-sectional profile. Upper surface 42 of body portion 36 is proximate to upper jaw member 26 and is substantially flat. It can be appreciated by those skilled in the art, that body portion 36 could have various other cross-sectional configurations. Further, in other embodiments of bottom jaw member 24, upper surface 42 may not be substantially flat. For example, body portion 36 could have more of a rounded or ovular cross-sectional profile. Attaching piece 38 is formed on bottom jaw member 24 proximate to body portion 36 toward distal end 28 of bottom jaw member 24. Attaching piece 38 is sized and configured to cooperate with corresponding structure on upper jaw member 26.

Figure 2:
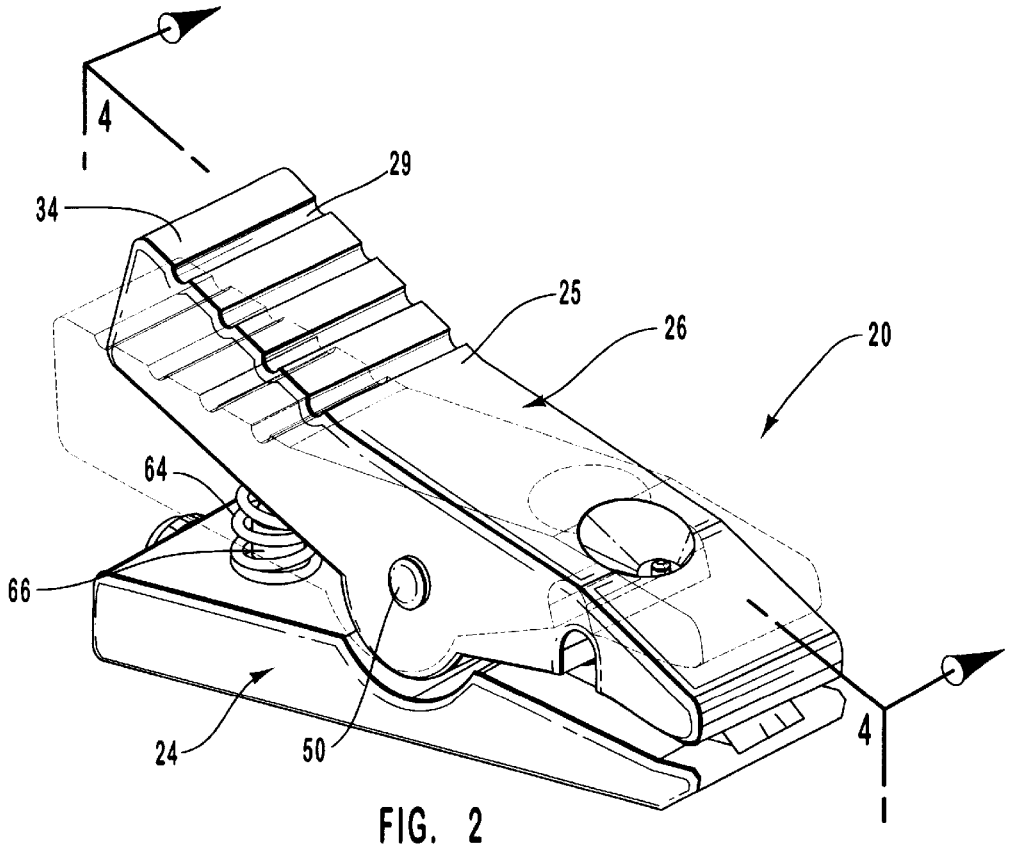
FIG. 2 is a perspective view of the electrode connector of FIG. 1 in the closed position with the open position shown in phantom.

Upper jaw member 26 also has a body portion 25 and a gripping portion 27. In one embodiment of upper jaw member 26 shown in FIG. 3, body portion 25 of upper jaw member 26 has two downwardly extending side walls 44. In FIG. 3, however, only one side wall 44 is visible. Side walls 44 are configured to cooperate with bottom jaw member 24, and in particular, attaching piece 38. As depicted in FIGS. 2 and 3, the outside surface of body portion 25 of upper jaw member 26 has optional grooves 29 formed therein that are intended to help the user grasp proximal end 34 of upper jaw member 26 and exert force thereon. Various other configurations of grooves 29 or other types of structures, such a bumps, are effective in carrying out the function thereof.

As illustrated in FIG. 3, on either side of attaching piece 38 on bottom jaw member 24 are recesses 46. Each recess 46 is sized and configured to cooperate with corresponding side walls 44 on upper jaw member 26. Upper jaw member 26 has a similar recess (not shown) formed therein that is configured to cooperate with the remote end of attaching piece 38 of bottom jaw member 24. On the embodiment of bottom jaw member 24 illustrated in FIG. 3, attaching piece 38 is depicted as being approximately laterally centered on bottom jaw member 24 with recesses 46 formed on either side. In addition, the remote end of attaching piece 38 is shown as having a substantially rounded profile. In the alternative, by way of example and not limitation, attaching piece 38 may be substantially square or rectangular shaped as long as the remote end thereof cooperates with the recess in upper jaw member 26 so as to allow bottom jaw member 24 and upper jaw member 26 to have rotational movement.

It can be appreciated by one skilled in the art that the specific configuration of attaching piece 38 of bottom jaw member 24 and side walls 44 of upperjaw member 26 along with the associated recesses configured to cooperate therewith are not particularly important to the present invention. What is important is that bottom jaw member 24 and upper jaw member 26 be configured so as to cooperate together such that upper jaw member 26 is movably attached to lower jaw member 24. This enables electrode connector 20 to move between the open position and closed position depicted in FIGS. 2 and 4A–4C.

Referring to FIG. 3, attaching piece 38 has an aperture 48 formed therein that is sized and configured to receive a connector pin 50. Aperture 48 is depicted as being substantially centered in attaching piece 38. Aperture 48 could, however, be formed in any position in attaching piece 38. Aperture 48 is formed so as to be substantially aligned with recesses 46 in bottom jaw member 24 about a lateral axis. Similarly, side walls 44 of upper jaw member 26 have holes 45 formed therein that are sized and configured to receive connector pin 50. Holes 45 are substantially aligned with aperture 48 formed in attaching piece 38 of bottom jaw member 24.

It can be appreciated by one skilled in the art that bottom jaw member 24 can be formed with various other arrangements and positions of attaching piece 38 and recesses 46 than that depicted in FIG. 3. What is important is that bottom jaw member 24 and upperjaw member 26 are configured to cooperate so as to be movably connected such that connector 20 can be selectively opened and closed by medical personnel. More specifically, attaching piece 38 can be located along one of the longitudinal sides of bottom jaw member 24. Correspondingly, there may only be one recess 46 formed in bottom jaw member 24 along the side of attaching piece 38. Similarly, with this alternate configuration, upper jaw member 26 would only have one downwardly extending side wall 44. Side wall 44 and recess 32 would be sized and configured to cooperate to allow rotational movement. Likewise, the remote end of attaching piece 38 and the recess formed in upperjaw member 26 would also be sized and configured to cooperate so as to allow rotational movement.

In another embodiment, attaching piece 38 and corresponding side wall 44 could be formed at various other positions along the length of bottom jaw member 24 and upper jaw member 26, respectively. Further, various methods of movably attaching upper jaw member 26 to bottom jaw member 24 other than pin 50 may be effectively utilized. For example, instead of a pin, a hinge or the like could be used.

Bottom jaw member 24 also includes a gripping portion 40 that forms distal end 28 of bottom jaw member 24. In one embodiment of bottom jaw member 24 depicted in FIG. 3, as one moves towards distal end 28 of bottom jaw member 24, gripping portion 40 tapers in thickness. In other words, gripping portion 40 becomes gradually thinner towards distal end 28 of bottom jaw member 24. Various other configurations of gripping portion 40 are also effective in carrying out the intended function thereof. For example gripping portion 40 may have a constant thickness.

Figure 4A:
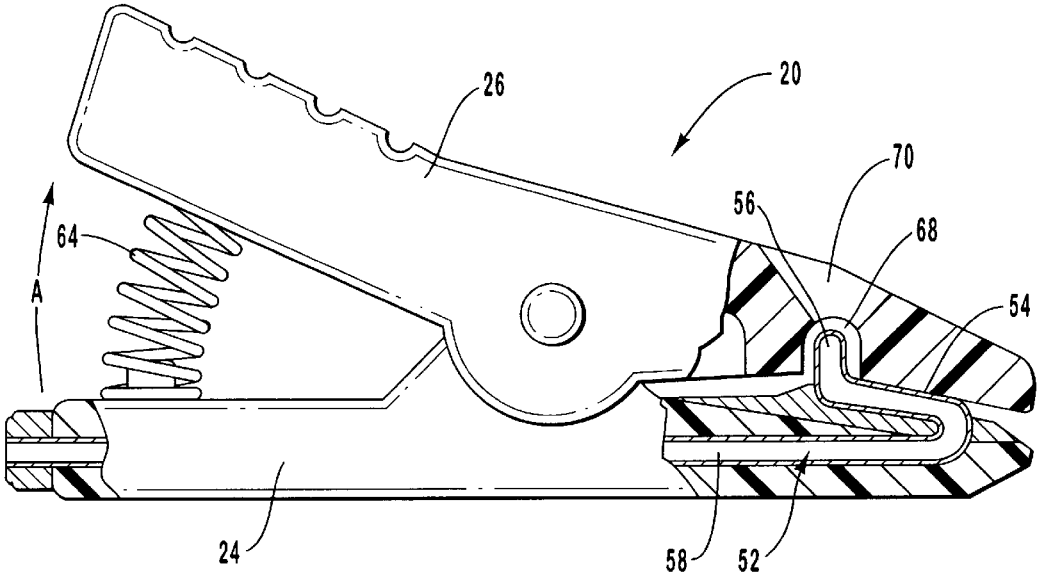
FIG. 4A is a partial break-away cross-sectional elevation view of the structure shown in FIG. 2 in the closed position and taken along the section line 4—4.
Figure 4B:
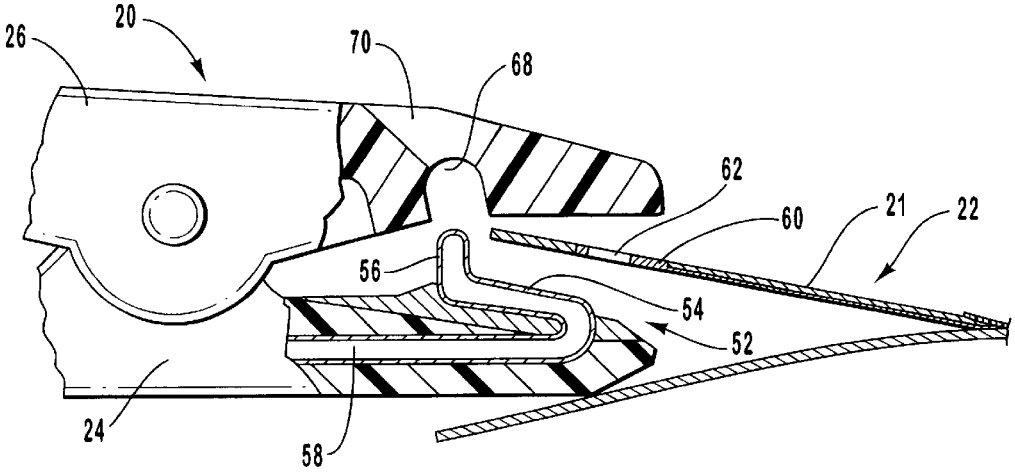
FIG. 4B is a partial break-away cross-sectional elevation view of the structure of FIG. 4A in the open position and with a portion of the flexible electrode being inserted into the connector.
Figure 4C:
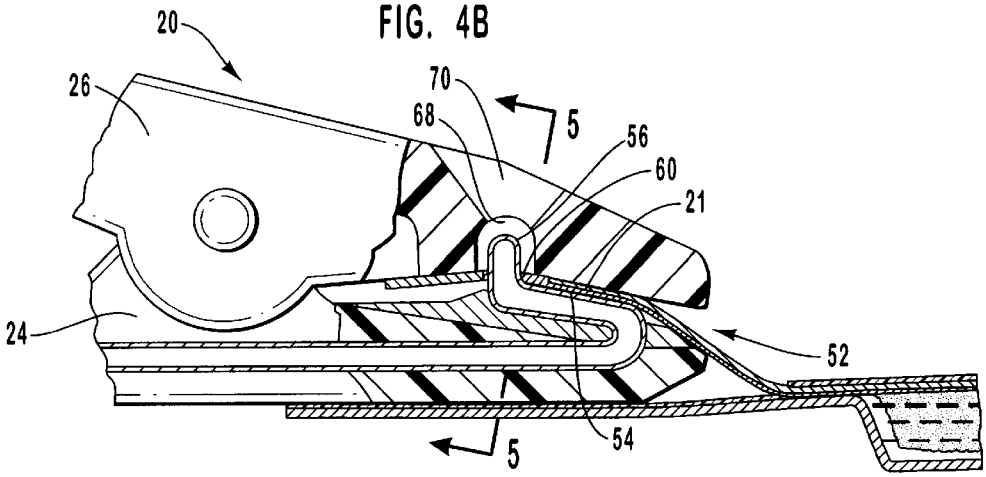
FIG. 4C is a partial break-away cross-sectional elevation view of the structure of FIG. 4A as attached to the flexible electrode.

Connector 20 includes means for providing electrical contact with flexible electrode 22. One example of structure capable of performing the function of such a contacting means is electrical contact assembly 52. One embodiment of electrical contact assembly is depicted in FIG. 3. As illustrated, electrical contact assembly 52 is disposed in bottom jaw member 24. Electrical contact assembly 52 comprises a contact platform 54 mounted in gripping portion 40 of bottom jaw member 24 and a contact pin 56. Contact pin 56 and contact platform 54 are in electrical contact with lead 58 that is attached to proximal end 32 of bottom jaw member 24 and extends through bottom jaw member 24 as depicted in FIGS. 4A–4C. In particular contact platform 54 is formed in lead 58 which is mounted in bottom jaw member 24. In one embodiment, lead 58 comprises a wire. Contact platform 54 formed by lead 58 is disposed in bottom jaw member 24 so that the upper portion of lead 58 and contact platform 54 lies above the plane formed by gripping portion 40 of bottom jaw member 24. Contact pin 56 is attached to contact platform 54 and extends upwardly from bottom jaw member 24 toward upper jaw member 26. In the presently preferred embodiment, contact pin 56 is substantially vertical. It can be appreciated that contact platform 54 may have a variety of other configurations. By way of example and not limitation, contact platform could be a plate in electrical contact with lead 58 and with contact ping 56 attached thereto.

Electrical contact assembly 52 also includes a recess 68 that is sized and configured to receive contact pin 56 therein. Various other configurations of structure are capable of performing the function electrical contact assembly 52. As can be appreciated by those skilled in the art that the positions of contact pin 56 and contact platform 54 formed in lead 58 could be reversed with recess 68. In other words, contact pin 56 and contact platform 54 formed by lead 58 would be disposed in upper jaw member 26 while recess 68 would be formed in bottom jaw member 24. In that embodiment, contact pin 56 would extend downwardly toward bottom jaw member 24.

Bottom jaw member 24 and upper jaw member 26 may be made of various kinds of materials, including but not limited to plastics, polymers, and metals or alloys there of that are coated with a nonconductive material. In the presently preferred embodiment, bottom jaw member 24 and upper jaw member 26 are molded from a medical grade plastic. It can be appreciated by one skilled in the art that electrical contact assembly 52 can be mounted in a cavity during manufacturing with the plastic molded about electrical contact assembly 52.

Contact platform 54 and contact pin 56 are sized and configured so as to cooperate with electrode 22 so that a good electrical contact can be formed therewith. Electrodes, such as electrode 22 are typically configured to have a contact area in which an electrode connector such as connector 20 is to be attached. In particular, contact platform 54 is configured such that electrical contact is formed with contact area 60 in tab portion 21 of flexible electrode 22 without permanently deforming and/or stretching contact area 60.

In the presently preferred embodiment, tab portion 21 of flexible electrode 22, as shown in FIG. 3, has a contact area 60 in which at least a portion of the contact area 60 is substantially fan-shaped or semi-circular. It can be appreciated by those skilled in the art that various other configurations of contact areas 60 of flexible electrode 22 may be utilized. Proximate to contact area 60 on flexible electrode 22 is an opening 62 sized and configured such that contact pin 56 will be disposed therein when electrode connector 20 is attached to flexible electrode 22.

According to one aspect of the present invention, the ability of contact pin 56 to be disposed in opening 62 in contact area 60 of electrode 22 provides a visual indicator to the medical personnel that electrode connector 20 is positively locked to electrode 22. This eliminates any guess work on whether the electrode connector is securely attached to electrode 22 and whether good electrical contact is formed. As a result, medical personnel can be sure that a good electrical contact is formed between flexible electrode 22 and electrode connector 20.

Therefore, in one embodiment of electrode connector 20, upper jaw member 26 is provided with an optional visual access opening 70 is in communication with recess 68 of electrical contact assembly 60. As illustrated, in one embodiment, visual access opening 70 is substantially aligned with recess 68 of electrical contact assembly 52. Visual access opening 70 is also substantially aligned with contact pin 56. When upper jaw member 26 and lowerjaw member 24 are in the closed position, contact pin 56 is visible through visual access opening 70 as depicted in FIG. 1. The positioning of visual access opening 70 enhances the ease with which medical personnel can quickly determine that contact pin 56 of electrical contact assembly 52 on electrode connector 20 is disposed in opening 62 of contact area 60 of tab portion 21 of flexible electrode 22. As illustrated in figures, particularly FIGS. 1 and 4A–4C, one embodiment of visual access opening 70 has tapered walls. It can be appreciated by one skilled in the art, that visual access opening 70 could have various other configurations and perform the function thereof. For example, the walls of visual access opening 70 may not be tapered. Further, visual access opening 70 may have other shapes than round such as oval, elliptical, square, octagonal, triangular or any combination thereof. It will also be appreciated that as previously mentioned, the positions of recess 68 along with optional visual access opening 70 could be reversed with that of contact pin 56 and contact platform 54 of electrical contact assembly 52 on upper jaw member 26 and lower jaw member 24 and perform the function thereof.

Various other configurations of contact pin 56 are capable of performing the function thereof. Although contact pin 56 is depicted as being cylindrical-shaped, contact pin 56 could have various other configurations and perform the functions thereof. What is important is that contact pin 56 and opening 62 be sized and configured such that contact pin 56 can be disposed opening 62 in flexible electrode 22, Further, contact pin 56 and recess 68 formed in upper jaw member 26 must also be similarly configured so as to cooperate together.

In addition, contact pin 56 may have other orientations that being vertical. Contact pin 54 may be at an angle relative to distal end 28 such that contact pin 56 is leaning toward distal end 28 of bottom jaw member. Correspondingly, recess 62 formed in upper jaw member 26 would correspondingly be angled such that contact pin 56 could be disposed therein when electrode connector is in the closed position.

Electrode connector 20 also includes biasing means for urging bottom jaw member 24 and upperjaw member 26 into the closed position, thereby urging contact pin 56 into recess 68 in upper jaw member 26. One example of structure capable of performing such a function is spring 64 that is mounted on upper surface 42 of bottom jaw member 24. Specifically, upper surface 42 has a post 66, most clearly illustrated in FIG. 2, that extends upwardly from bottom jaw member 24 toward upper jaw member 26. Post 66 is sized such that spring 64 can be disposed over post 66 on bottom jaw member 24. In addition, upper jaw member 26 has a depression formed in body portion 25 that is substantially aligned with post 66 and is configured to retain the free end of spring 64 therein. Further, gripping portion 27 in upper jaw member 26 is angled to cradle contact area 60 in tab portion 21 of flexible electrode 22 against contact platform 54 of contact assembly 52. Spring 64 is positioned on bottom jaw member 24 so as to urge electrode connector 20 into the closed position depicted in FIG. 2 and 4A.

Referring to FIG. 4A, recess 68 formed in gripping portion 60 of upper jaw member 26. Recess 68 is sized and configured such that contact pin 56 can be disposed therein without touching any portion of upper jaw member 26.

When spring 64 urges electrode connector 22 into the closed position as depicted by arrow A, contact pin 56 is also urged into recess 68 formed in upper jaw member 26. Various other types of springs are equally effective in performing the function thereof For example instead of the spring shown in FIG. 3, a leaf spring could be used.

In use, the user presses on proximal ends 32 and 34 of bottom jaw member 24 and upper jaw member 26, respectively, of electrode connector 20 with sufficient force to overcome spring 64 and to move electrode connector 20 into the open position depicted in FIG. 4B. A portion of flexible electrode 22, such as tab portion 21, can now be inserted between upper jaw member 26 and bottom jaw member 24 until contact pin 56 is disposed through opening 62 formed in contact area 60 of flexible electrode 22. The user is able to visually observe that contact pin 56 is actually disposed in opening 62.

When the user releases proximal ends 32 and 34 of bottom jaw member 24 and upper jaw member 26, respectively, spring 64 urges bottom jaw member 24 and upper jaw member 26 of electrode connector 20 into the closed position as illustrated in FIG. 4C. In addition, visual access opening 70 formed through upper jaw member 26 allows the user to immediately and visually confirm that contact pin 56 is correctly positioned in opening 62 of flexible electrode 22 and is in position to form the necessary electrical contact between connector 20 and flexible electrode 22. Having contact pin 56 disposed in opening 62 positively locks connector 20 to flexible electrode 22 to help prevent any accidental detachment or partial or total disengagement of electrode connector 20 and flexible electrode 22 causing a break in the electrical connection formed between electrode connector 20 and flexible electrode 22.

Upon contact pin56 being disposed in opening 62, contact platform 54 on bottom jaw member 24 is aligned with contact area 60 of flexible electrode 22. In this position, gripping portion 40 of bottom jaw member 24 and gripping portion 27 of upper jaw member 26 securely grasp flexible electrode 22. Contact area 60 of flexible electrode 22 is held in contact with contact platform 54 in bottom jaw member 24.

As illustrated in FIG. 4C, recess 68 formed in upper jaw member 26 is sized such that both contact pin 54 and a portion of contact area 60 of flexible electrode 22 can be disposed therein. Recess 68 of upperjaw member 26 allows contact area 60 of electrode 22 to be cradled in between recess 68 and contact platform 54 without permanently deforming contact area 60. Instead, contact area 60 is carefully pushed by gripping portion 27 of upper jaw member 26 into contact with contact platform 54 of lead 58. The configuration of gripping portion 27 of upper jaw member 26 and recess 68 help minimize lateral rotation of tab portion 21 within electrode connector 20 after an electrical connection is made.

Figure 5:
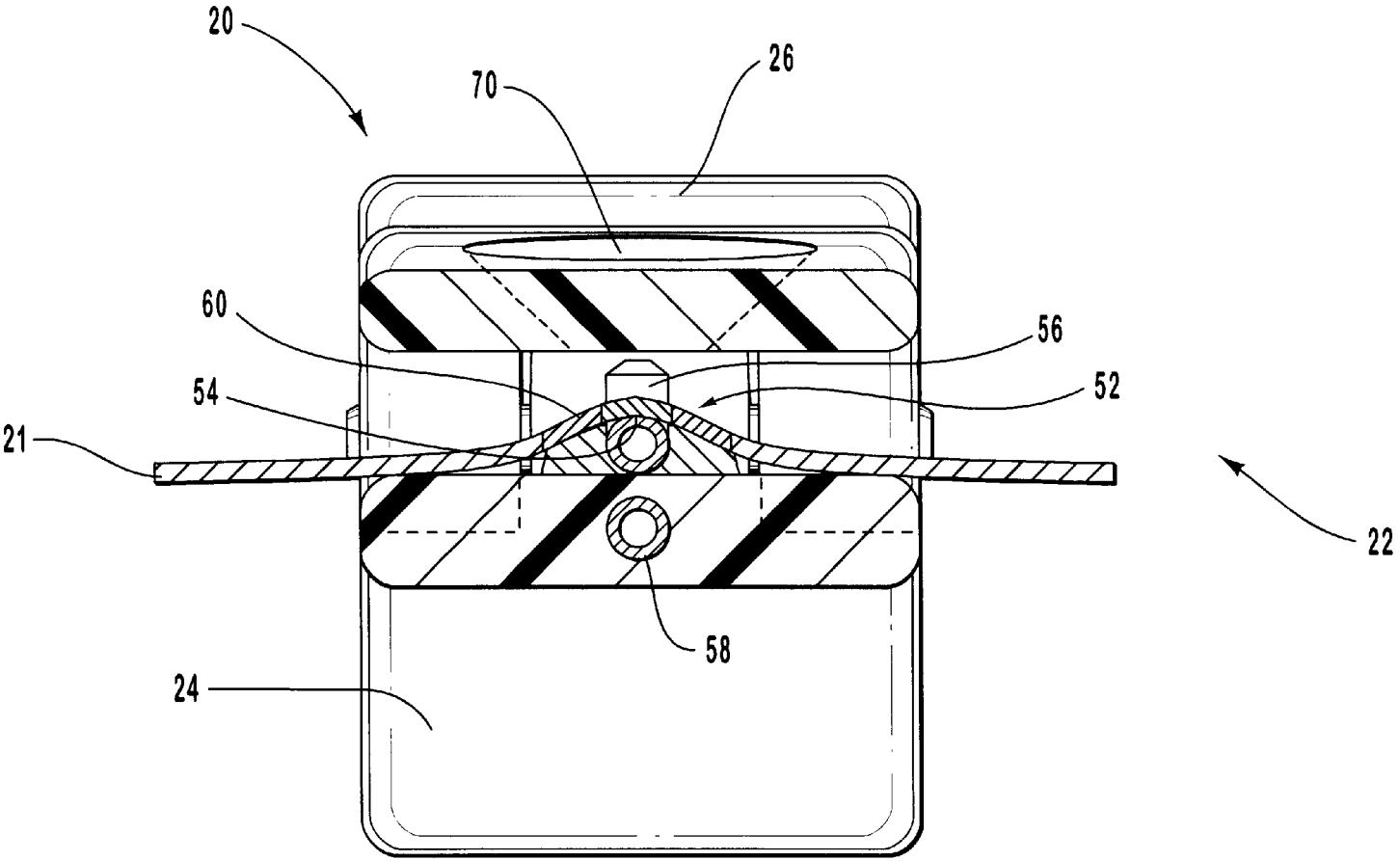
FIG. 5 is a cross-sectional view of the structure of FIG. 4C taken along section line 5—5.

As shown in FIG. 5, when electrode connector 20 is in the closed position, contact pin 56 is disposed in opening 62 formed in contact area 60 and contact area 60 conformed to the shape of contact platform 54 formed by lead 58, thereby allowing a strong electric connection to be made and maintained by electrical contact assembly 52. Recess 68 formed in upper jaw member 26 is configured such that both contact pin 56 and a portion of contact area 60 of flexible electrode 22 can be disposed therein without permanent deformation and/or stretching of flexible electrode 22. Further, recess 68 is configured such that upon electrode contact being urged into the closed position, contact area 60 of flexible electrode 22 is urged against contact platform 54 of electrical contact assembly 52 without permanently deforming contact area 60. Any slight bending of electrode 22 that may occur is nonpermanent and when flexible electrode is removed from electrode connector 20 returns to substantially the original shape. It will be appreciated that although recess 68 is depicted in the figures as being a lateral channel, recess 68 could have various other configurations. For example, recess 68 could be an oversized recess or opening of any configuration as long as it is sized and configured to receive both contact pin 56 and a portion of contact area 60 of flexible electrode therein and does not permanently deform electrode 22.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. An electrode connector for securely holding a thin flexible electrode that is attached to a patient, the flexible electrode having an aperture formed therethrough and a contact area, the connector comprising:

(a) a bottom jaw member;

(b) an upper jaw member movably attached to said bottom jaw member;

(c) contacting means for providing electrical contact with the flexible electrode, said contacting means being sized and configured to be at least partially disposed in the aperture formed through the flexible electrode such that electrical contact is formed and maintained with a contact area of the flexible electrode without permanently deforming the contact area thereof, and (d) means for precluding rotation of the flexible electrode relative to the electrode connector, the rotation precluding means comprising a longitudinally convex surface associated with one of the bottom jaw member and the upper jaw member, and a longitudinally mating surface associated with the other of the bottom jaw member and the upper jaw member, the convex and mating surfaces capable of mating engagement when the upper jaw member and the bottom jaw member are in a closed position.

2. An electrode connector as recited in claim 1, wherein disposing said contacting means in the aperture of the flexible electrode positively locks the connector to the flexible electrode.

3. An electrode connector as recited in claim 1, wherein said upper jaw member and said bottom jaw member are selectively movable between an open position and a closed position.

4. An electrode connector as recited in claim 3, wherein said contacting means, said bottom jaw member and said upper jaw member are configured such that upon said bottom jaw member and said upper jaw member moving to said closed position a substantial portion of said contact area of the flexible electrode is in electrical contact with said contacting means.

5. An electrode connector as recited in claim 1, wherein said contacting means comprises:

(a) a contact platform attached to one of said bottom jaw member or said upper jaw member; and (b) a contact pin attached to said contact platform.

6. An electrode connector as recited in claim 5, wherein said contact means is configured such that disposing said contact pin in the aperture in the flexible electrode provides a visual indicator to medical personnel that the contact assembly and the flexible electrodes are correctly aligned so as to form an electrical contact.

7. An electrode connector as recited in claim 6, wherein one of the bottom jaw member and the upper jaw member further comprises a visual access opening, said visual opening enhancing the ability to medical personnel to visually determine that said contact pin is disposed in the aperture in the flexible electrode.

8. An electrode connector as recited in claim 3, wherein said upper jaw member and said bottom jaw member are biased into said closed position.

9. An electrode connector for securely holding a thin flexible electrode that is attached to a patient, the flexible electrode having an apertured formed therethrough and a contact area, the connector comprising:

(a) a bottom jaw member;

(b) a upper jaw member attached to said bottom jaw member, said upper jaw member and said bottom jaw member being selectively movable between an open position and a closed position; and (c) an electrical contact assembly configured to provide electrical contact with the flexible electrode, said electrical contact assembly comprising:

(i) a contact platform attached to one of said bottom jaw member or said upper jaw member; and (ii) a contact pin attached to said contact platform, said contact pin being sized and configured to be at least partially disposed in the aperture formed in the flexible electrode such that upon said upper jaw member and said bottom jaw member moving to closed position electrical contact is formed and maintained with the contact area of the flexible electrode without permanently deforming the contact area thereof (d) means for precluding rotation of the flexible electrode relative to the electrode connector, the rotation precluding means comprising a longitudinally convex surface associated with one of the bottom jaw member and the upper jaw member, and a longitudinally mating surface associated with the other of the bottom jaw member and the upper jaw member, the convex and mating surfaces capable of mating engagement when the upper jaw member and the bottom jaw member are in a closed position.

10. An electrode connector as recited in claim 9, wherein said contact assembly is configured such that disposing said contact pin in the aperture in the flexible electrode provides a visual indicator to medical personnel that said electrical contact assembly and the flexible electrode are correctly aligned so as to form an electrical contact.

11. An electrode connector as recited in claim 10, further comprising a visual access opening formed in one of said upper jaw member and said bottom jaw member opposite said contact pin, said visual access opening being substantially aligned with said contact pin, said visual access opening enhancing the ability of medical personnel to visually determine that said contact pin is disposed in the aperture in the flexible electrode.

12. An electrode connector as recited in claim 9, wherein said electrical contact assembly further comprises a recess formed in one of said bottom jaw member or said upper jaw member opposite said contact pin.

13. An electrode connector as recited in claim 12, wherein:

(a) said recess is formed in said upper jaw member; and (b) said contact platform is attached to said bottom jaw member, said contact platform being configured to form said electrical contact with the contact area of the flexible electrode.

14. An electrode connector as recited in claim 9, wherein said contact pin extends substantially vertically away from either said bottom jaw member or said upper jaw member.

15. An electrode connector as recited in claim 9, wherein disposing said contact pin in the aperture in the flexible electrode positively locks the connector to the flexible electrode.

16. An electrode connector as recited in claim 13, wherein said recess is sized and configured to receive both said contact pin disposed in the aperture of the flexible electrode and a portion of the contact area of the flexible electrode.

17. An electrode connector as recited in claim 13, wherein upon said upper jaw member and said bottom jaw member being in said closed position both said contact pin disposed in the aperture of the flexible electrode and a portion of the contact area of the flexible electrode are held in said recess without permanently deforming the contact area of the flexible electrode.

18. An electrode connector as recited in claim 13, wherein said upper jaw member and said bottom jaw member are biased into said closed position, thereby urging said contact pin into said recess.

19. An electrode connector as recited in claim 9, wherein said bottom jaw member and said upper jaw member are substantially comprised of a plastic material.

20. The electrode connector as recited in claim 9 wherein the contact platform is positioned longitudinally along one of the convex and mating surfaces of one of the upper jaw member and bottom jaw member.

21. The electrode connector as recited in claim 9 wherein the contact platform and the contact pin comprise a substantially uniform cylindrical member positioned longitudinally along one of the convex and mating surfaces of one of the upper jaw member and the bottom jaw member.

22. An electrode connector for securely holding a thin flexible electrode that is attached to a patient, the flexible electrode having an aperture formed therethrough and a contact area, the connector comprising:

(a) a bottom jaw member;

(b) a upper jaw member attached to said bottom jaw member, said upper jaw member and said bottom jaw member being selectively movable between an open position and a closed position, said upper jaw member having a recess formed therein; and (c) an electrical contact assembly configured to provide electrical contact with the flexible electrode, said electrical contact assembly comprising:

(i) a contact platform attached to said bottom jaw member, said contact platform being configured to form said electrical contact with the contact area of the flexible electrode; and (ii) a contact pin attached to said contact platform, said contact pin being sized and configured so as to be disposed in said recess in said upper jaw member, said contact pin further being sized and configured to be at least partially disposed in the aperture formed through the flexible electrode such that upon said upper jaw member and said lower jaw member moving to closed position electrical contact is formed and maintained with the contact area of the flexible electrode substantially without permanently deforming the contact area thereof (d) means for precluding rotation of the flexible electrode relative to the electrode connector, the rotation precluding means comprising a longitudinally convex surface associated with one of the bottom jaw member and the upper jaw member, and a longitudinally mating surface associated with the other of the bottom jaw member and the upper jaw member, the convex and mating surfaces capable of mating engagement when the upper jaw member and the bottom jaw member are in a closed position.

23. An electrode connector as recited in claim 22, wherein said contact assembly is configured such that disposing said contact pin in the aperture in the flexible electrode provides a visual indicator that the contact assembly and the flexible electrode are correctly aligned so as to form an electrical contact.

24. An electrode connector as recited in claim 23, further comprising a visual access opening formed in said upper jaw member and being in communication with said recess, said visual access opening also being substantially aligned with said contact pin so as to enhance the ability of medical personnel to visually determine that said contact pin is disposed in the aperture in the flexible electrode.

25. An electrode connector as recited in claim 22, wherein disposing said contact pin in the aperture in the flexible electrode positively locks the connector to the flexible electrode.

26. An electrode connector as recited in claim 22, wherein said contact pin extends substantially vertically away from said bottom member toward said upper member.

27. An electrode connector as recited in claim 22, wherein said recess formed in said upper jaw member is sized and configured to receive both said contact pin disposed in the aperture of the flexible electrode and a portion of the contact area of the flexible electrode.

28. An electrode connector as recited in claim 22, wherein said upper jaw member and said bottom jaw member are biased into said closed position, thereby urging said contact pin into said recess in said upper jaw member.

29. An electrode connector as recited in claim 22, wherein said bottom jaw member and said upper jaw member are substantially comprised of a plastic material.

30. An electrode connector as recited in claim 27, wherein said biasing means comprises a spring sized and configured to urge said upper jaw member and said bottom jaw member into said closed position, thereby urging said contact pin into said recess.

31. An electrode connector as recited in claim 30, further comprising:

(a) a post formed on one of said bottom jaw member or said upper member for positioning said spring.

32. An electrode connector as recited in claim 31, wherein said spring is disposed over said post and extends between said upper jaw member and said lower jaw member.

* * * * *